US008736593B2

(12) United States Patent
Lee et al.

(10) Patent No.: US 8,736,593 B2
(45) Date of Patent: May 27, 2014

(54) POWER SOURCE CIRCUIT HAVING A PROTECTOR TO CONTROL AN OPERATION OF A VOLTAGE GENERATOR AND DISPLAY APPARATUS HAVING THE SAME

(75) Inventors: Chang-Soo Lee, Cheonan-si (KR); Jong Jae Lee, Asan-si (KR); Yunjae Park, Seoul (KR)

(73) Assignee: Samsung Display Co., Ltd., Yongin, Gyeonggi-Do (KR)

( * ) Notice: Subject to any disclaimer, the term of this patent is extended or adjusted under 35 U.S.C. 154(b) by 765 days.

(21) Appl. No.: 12/899,848

(22) Filed: Oct. 7, 2010

(65) Prior Publication Data

US 2011/0193844 A1 Aug. 11, 2011

(30) Foreign Application Priority Data

Feb. 5, 2010 (KR) ..... 10-2010-0010987

(51) Int. Cl.
*G09G 5/00* (2006.01)

(52) U.S. Cl.
USPC ..... 345/211

(58) Field of Classification Search
CPC ..... G09G 2330/021; G09G 2330/04; G09G 2330/045
USPC ..... 345/211, 212, 87, 95; 323/288
See application file for complete search history.

(56) References Cited

U.S. PATENT DOCUMENTS

| | | | | |
|---|---|---|---|---|
| 6,069,471 | A * | 5/2000 | Nguyen | 323/271 |
| 6,958,595 | B2 * | 10/2005 | Niiyama et al. | 323/282 |
| 2005/0275391 | A1 * | 12/2005 | Ito et al. | 323/282 |
| 2007/0114952 | A1 * | 5/2007 | Yang | 315/307 |
| 2008/0150500 | A1 * | 6/2008 | Gurcan | 323/271 |
| 2009/0021232 | A1 * | 1/2009 | Ishino | 323/288 |
| 2009/0278832 | A1 * | 11/2009 | Cho et al. | 345/211 |
| 2009/0289930 | A1 * | 11/2009 | Nishimura | 345/211 |
| 2009/0322426 | A1 * | 12/2009 | Nyboe et al. | 330/251 |
| 2010/0265231 | A1 * | 10/2010 | Jang | 345/211 |

FOREIGN PATENT DOCUMENTS

| | | |
|---|---|---|
| JP | 2007-298737 | 11/2007 |
| JP | 2009-192650 | 8/2009 |
| KR | 1020060055057 | 5/2006 |

* cited by examiner

*Primary Examiner* — Chanh Nguyen
*Assistant Examiner* — Jonathan Blancha
(74) *Attorney, Agent, or Firm* — F. Chau & Associates, LLC

(57) ABSTRACT

A power source circuit of a display apparatus includes a voltage divider, an operational amplifier, a first switch, a second switch, and a protector. The voltage divider generates a divided voltage between a first driving voltage and a ground voltage. The operational amplifier receives the divided voltage and outputs the divided voltage as a second driving voltage. The first switch is connected between a first supply voltage terminal to receive the first driving voltage and a common node. The second switch is connected between the common node and a second supply voltage terminal to receive the ground voltage. The protector is connected to the common node to limit a voltage output of the first supply voltage terminal in response to a voltage of the common node.

21 Claims, 5 Drawing Sheets

POWER SOURCE CIRCUIT HAVING A PROTECTOR TO CONTROL AN OPERATION OF A VOLTAGE GENERATOR AND DISPLAY APPARATUS HAVING THE SAME

CROSS-REFERENCE TO RELATED APPLICATION

This application claims priority to Korean Patent Application No. 2010-10987, filed on Feb. 5, 2010, the disclosure of which is incorporated by reference herein in its entirety.

BACKGROUND

1. Technical Field

Embodiments of the present invention relate to a power source circuit of a display apparatus, and more particularly to a power source circuit of a display apparatus, capable of preventing an operation failure by reducing power consumption.

2. Discussion of Related Art

A liquid crystal display (LCD) includes a liquid crystal display panel including a lower substrate, an upper substrate facing the lower substrate, and a liquid crystal layer interposed between the lower and upper substrates, for displaying an image. The liquid crystal display panel further includes a plurality of gate lines, a plurality of data lines, and a plurality of pixels connected to the gate and data lines.

The LCD further includes a gate driver and a data driver. The gate driver may sequentially output gate pulses to the gate lines and the data driver outputs pixel voltages to the data lines. The gate and data drivers may be provided in the form of a driving chip and mounted on a film or the liquid crystal display panel.

FIG. 1 is a view showing an example of supplying a current to a driving chip 10 of a data driver. The driving chip 10 includes first and second power terminals 11 and 12. The first power terminal 11 of the driving chip 10 receives a supply voltage AVDD, and the second power terminal 12 receives a ground voltage VSS. Power consumed by the liquid crystal display panel may correspond to the power supply voltage AVDD multiplied by a current $I_A$ applied to the first power terminal 11. Further, power consumed by the driving chip 10 may be identical to the power consumed by the liquid crystal display panel.

High-speed driving schemes have been continuously developed to improve image quality due to the ever increasing size of liquid crystal display panels. In these schemes, the level of the supply voltage AVDD relative to the ground voltage VSS has been gradually raised over time. For example, in one embodiment, the supply voltage AVDD has been increased to about 15V. The increased supply voltage AVDD results in a larger potential difference between the supply voltage AVDD and the ground voltage VSS, thereby increasing power consumption. Further, the increase in power consumption increases the operating temperature of the driving chip 10, which may result in an operation failure.

SUMMARY

At least one exemplary embodiment of the prevent invention provides a power source circuit capable of preventing the operation failure of a driving chip (e.g., due to excessive operating temperature).

At least one exemplary embodiment of the prevent invention provides a display apparatus having the power source circuit.

According to an exemplary embodiment of the present invention, a power source circuit includes a voltage divider, an operational amplifier, a first switch, a second switch, and protector. The voltage divider is connected between a first supply voltage terminal to receive a first driving voltage and a second supply voltage terminal to receive a ground voltage, thereby generating a divided voltage. The operational amplifier receives the divided voltage and outputs the divided voltage as a second driving voltage. The first switch is connected between the first supply voltage terminal and a common node (e.g., to form a first current path between the first supply voltage terminal and the common node) in response to the second driving voltage. The second switch is connected between the common node and the second supply voltage terminal (e.g., to form a second current path between the common node and the second supply voltage terminal) in response to the second driving voltage. The protector is connected to the common node to limit a voltage output of the first supply voltage terminal in response to a voltage of the common node.

According to an exemplary embodiment of the present invention, a display apparatus includes a power source circuit, a driving circuit, and a display panel. The power source circuit supplies a plurality of supply voltages. The driving circuit receives the supply voltages to output a grayscale voltage. The display panel receives the grayscale voltage to display an image.

The power source circuit includes a first voltage generator, a second voltage generator, and a protector. The first voltage generator boosts an input voltage to generate a first driving voltage among the supply voltages. The second voltage generator receives the first driving voltage from the first voltage generator to generate a second driving voltage having a level lower than a level of the first driving voltage. The protector controls an operation of the first voltage generator according to a magnitude of the second driving voltage.

BRIEF DESCRIPTION OF THE DRAWINGS

Exemplary embodiments of the present invention will become readily apparent by reference to the following detailed description when considered in conjunction with the accompanying drawings wherein.

DESCRIPTION OF EXEMPLARY EMBODIMENTS

Figure 1:
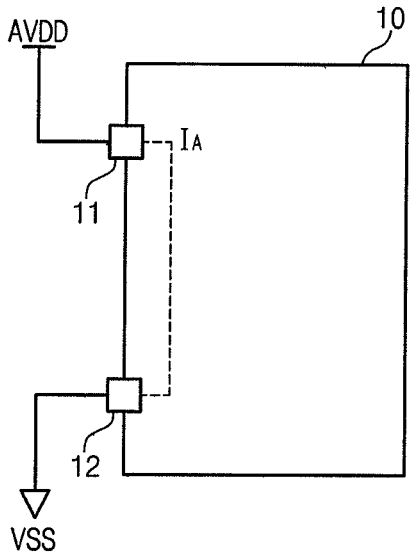
FIG. 1 is a view showing an example of supplying a current to a driving chip.

Hereinafter, exemplary embodiments of the present invention will be described in more detail with reference to accompanying drawings. However, the present invention is not limited to the following exemplary embodiments. When describing each attached drawing, like reference numerals designate similar or like components. Hereinafter, exemplary embodiments of the present invention will be described in detail with reference to accompanying drawings.

Figure 2:
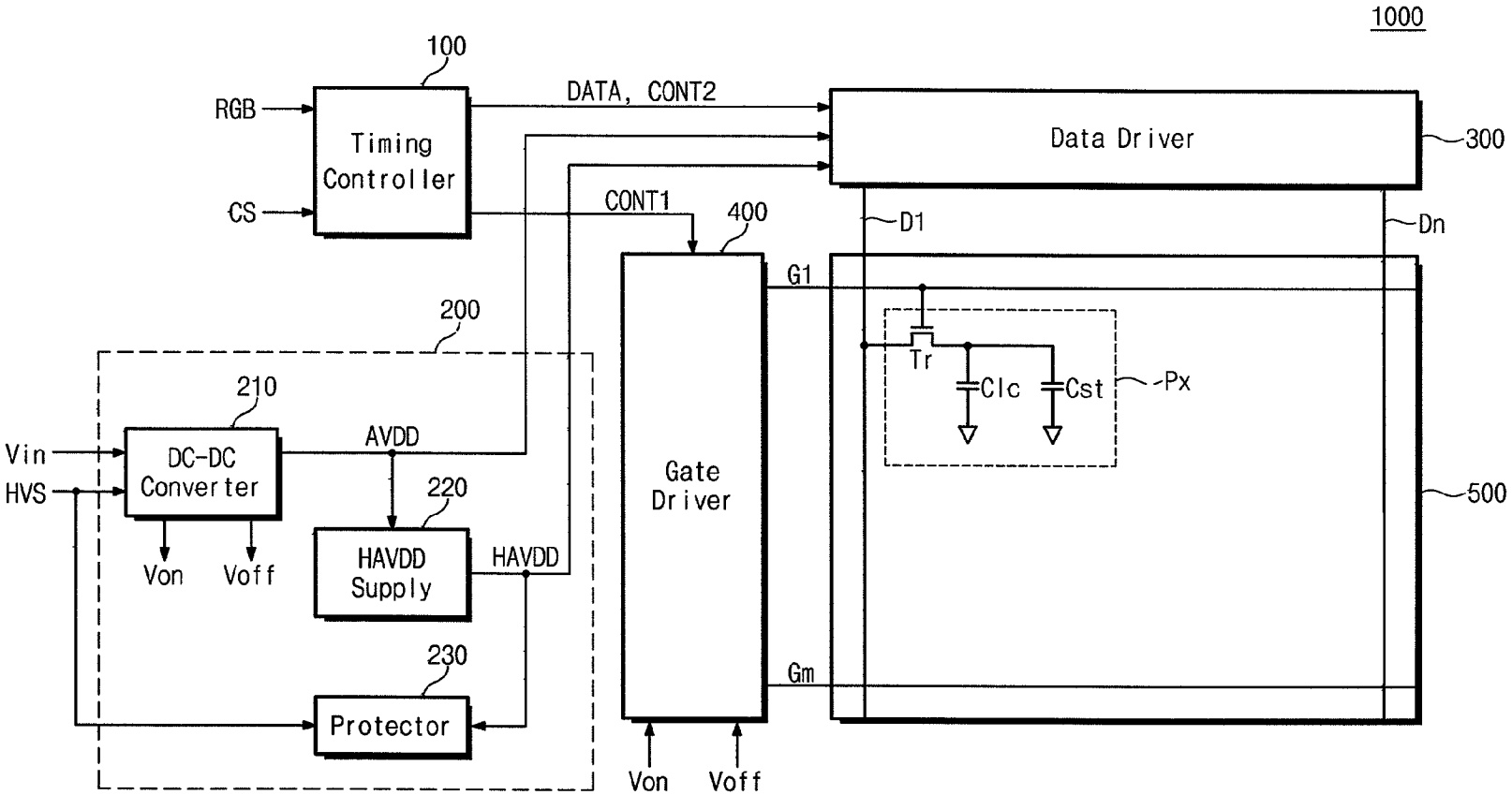
FIG. 2 is a block diagram showing an LCD according to an exemplary embodiment of the present invention.

FIG. 2 is a block diagram showing a liquid crystal display (LCD) 1000 according to an exemplary embodiment of the present invention. Referring to FIG. 2, the LCD 1000 includes a timing controller 100, a power supply 200, a data driver 300, a gate driver 400, and a liquid crystal panel 500.

The timing controller 100 controls the data driver 300 and the gate driver 400 in response to an image signal RGB and a control signal CS, which may be input from an external source. The timing controller 100 generates a gate control signal CONT1 and a data control signal CONT2 and transfers the gate and data control signal CONT1 and CONT2 to the gate and data drivers 400 and 300, respectively, in response to the control signal CS. The timing controller 100 converts the format of the image signal RGB to transfer an image signal DATA to the data driver 300.

The power supply 200 supplies driving power to the data and gate drivers 300 and 400. For example, the power supply 200 receives an input voltage Vin (e.g., from an external source) to generate an analog driving voltage AVDD, a half driving voltage HAVDD, a gate on voltage Von, and a gate off voltage Voff. The power supply 200 transfers the analog driving voltage AVDD and the half driving voltage HAVDD to the data driver 300, and transfers the gate on voltage Von and the gate off voltage Voff to the gate driver 400. Although not shown in FIG. 2, the power supply 200 may further include a common voltage generator to generate a common voltage and supply the common voltage to the liquid crystal panel 500.

The power supply 200 includes a direct-current to direct-current (DC-DC) converter 210, an HAVDD supply 220, and a protector 230. The DC-DC converter 210 receives the input voltage Vin, boosts the input voltage Vin to the analog driving voltage AVDD, and outputs the analog driving voltage AVDD. The DC-DC converter 210 may further generate the gate on voltage Von and the gate off voltage Voff. The HAVDD supply 220 receives the analog driving voltage AVDD, which is output from the DC-DC converter 210, to generate the half driving voltage HAVDD and supplies the half driving voltage HAVDD to the data driver 300. The protector 230 detects the level of the half driving voltage HAVDD output from the HAVDD supply 220 to control the DC-DC converter 210 to prevent the data driver 300 from erroneously operating. An exemplary operation of the power supply 200 will be described below with reference to FIG. 3.

The data driver 300 receives the analog driving voltage AVDD and the half driving voltage HAVDD from the power supply 200, and receives the image signal DATA and the data control signal CONT2 from the timing controller 100. The data driver 300 may generate an analog grayscale voltage corresponding to the image signal DATA, which is transferred from the timing controller 100, by using the analog driving voltage AVDD and the half driving voltage HAVDD. The data driver 300 may include at least one driving chip and may be mounted on the liquid crystal panel 500 or a film (not shown) attached to the liquid crystal panel 500.

The gate driver 400 receives the gate on voltage Von and the gate off voltage Voff from the power supply 200, and receives the gate control signal CONT1 from the timing controller 100. The gate driver 400 may sequentially output gate signals in response to the gate control signal CONT1. The gate signals may be set to the gate on voltage Von or the gate on voltage Voff. According to an exemplary embodiment of the invention, the gate driver 400 may include an amorphous silicon gate (ASG) and may be formed when the liquid crystal display panel 500 is manufactured.

The liquid crystal panel 500 includes upper and lower substrates (not shown) facing each other and a liquid crystal (not shown) interposed between the upper and lower substrates. When viewed in an equivalent circuit, the liquid crystal panel 500 may include data lines D1 to Dn, gate lines G1 to Gm, and a plurality of pixels Px. The data lines D1 to Dn are connected to the data driver 300 to receive the analog grayscale voltage, and the gate lines G1 to Gm are connected to the gate driver 400 to receive the gate signals.

At least one pixel Px is connected to a corresponding data line of the data lines D1 to Dn and a corresponding gate line of the gate lines G1 to Gm. The gate lines G1 to Gm may be substantially parallel to each other while extending in a substantially row direction. The data lines D1 to Dn may be substantially parallel to each other while extending in a substantially column direction. At least one of the pixels Px may include a switching device Tr connected to corresponding gate and data lines, a liquid crystal capacitor C1*c* connected to the switching device Tr, and a storage capacitor Cst connected to the liquid crystal capacitor C1*c* in parallel. The storage capacitor Cst may be omitted if necessary. The switching device Tr may be a thin film transistor.

If a gate signal having the gate on voltage Von is applied to a corresponding gate line, the thin film transistor Tr of a liquid crystal cell is turned on. If an analog grayscale voltage is applied to a corresponding data line, the analog grayscale voltage is charged in the liquid crystal capacitor C1*c*. If a gate signal having the gate off voltage Voff is applied to the gate line, the thin film transistor Tr of the liquid crystal cell is turned off. Each pixel Px drives liquid crystal according to the voltage charged in the liquid crystal capacitor C1*c*, thereby adjusting light transmittance.

The number of driving chips included within the data driver 300 may depend upon the resolution of the liquid crystal panel 500, the number of channels of each driving chip, and an operating frequency. Table 1 shows examples of the number of driving chips provided in the LCD 1000 having a resolution of 1920*100 representing full high definition (FHD) according to the operating frequency and the number of channels of each driving chip.

TABLE 1

| Operating Frequency | 414 channels | 576 channels | 720 channels | 960 channels |
|---|---|---|---|---|
| 60 Hz | 14 | 10 | 8 | 6 |
| 120 Hz | 28 | 20 | 16 | 12 |
| 240 Hz | 56 | 40 | 32 | 24 |

For example, when each driving chip has 720 channels and the operating frequency is 240 Hz, the LCD 1000 includes at least 32 driving chips. However, when space is limited, it may not be possible to use a data driver 300 including 32 driving chips.

If the number of the channels of each driving chip is increased to 960, the number of required driving chips is reduced to 24 when the operating frequency is 240 Hz. However, as the number of the channels in each driving chip is increased, the operating temperature of the driving chip may increase. For example, if the driving chip has 960 channels, the operating temperature of the driving chip may exceed about 150° C. when a test pattern is input. When the number of the channels in each driving chip is increased to cause an unsafe rise in operating temperature, it would be beneficial if the LCD could minimize this rise.

Figure 3:
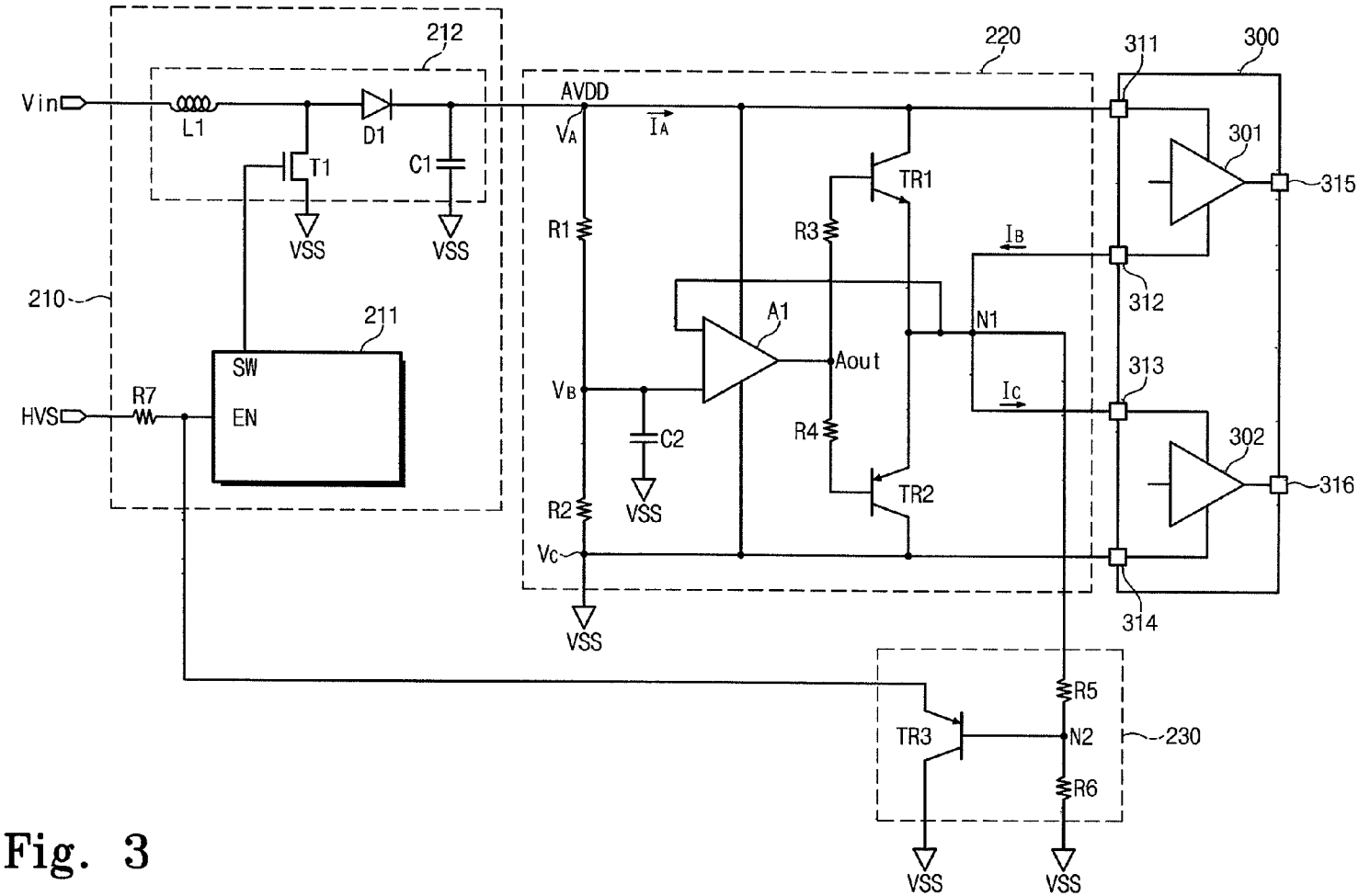
FIG. 3 is a circuit diagram of a power supply shown in FIG. 2 according to an exemplary embodiment of the present invention.

FIG. 3 is a circuit diagram showing the power supply 200 shown in FIG. 2 according to an exemplary embodiment of present invention. Referring to FIG. 3, the power supply 200 includes the DC-DC converter 210, the HAVDD supply 220, and the protector 230.

The DC-DC converter 210 receives the input voltage Vin to generate the analog driving voltage AVDD. Although not shown in FIG. 3, the DC-DC converter 210 may further generate the gate on voltage Von and the gate off voltage Voff.

The DC-DC converter 210 includes a pulse width modulation (PWM) modulator 211 and a boost converter 212. The boost converter 212 includes an inductor L1, a diode D1, a first capacitor C1, and a transistor T1, and boosts the input voltage Vin to generate the analog driving voltage AVDD.

One end of the inductor L1 receives the input voltage Vin, and an opposite end of the inductor L1 is connected to an input terminal of the diode D1. A first electrode of the transistor T1 is connected to the opposite end of the inductor L1, a second electrode (e.g., a gate) of the transistor T1 is connected to a switching terminal SW of the PWM modulator 211, and a third electrode of the transistor T1 receives the ground voltage VSS. The input terminal of the diode D1 is connected to the first electrode of the transistor T1, and an output terminal of the diode D1 is connected to a first electrode of the first capacitor C1. The ground voltage VSS is applied to a second electrode of the first capacitor C1. The output terminal of the diode D1 outputs the analog driving voltage AVDD. As an example, the diode D1 may be a Schottky diode, but is not limited thereto.

An operation of the PWM modulator 211 is started based on receipt of a starting voltage HVS (e.g., 3.3 V) through an enable terminal EN, which has been transferred from the timing controller 100. Since a resistor R7 is connected to the enable terminal EN, a voltage applied to the resistor R7 may be supplied to the enable terminal EN. The PWM modulator 211 operates if the voltage received through the enable terminal EN is greater than or equal to a threshold voltage (e.g., about 1.2 V), and does not operate if the voltage received through the enable terminal EN is less than the threshold voltage (e.g., about 1.2 V).

The DC-DC converter 210 may further include at least two resistors connected to an output terminal through which the analog driving voltage AVDD is output. The PWM modulator 211 may further include a feed-back circuit receiving a voltage of a node, which connects the two resistors to each other, which through feedback, controls the boost converter 212. The PWM modulator 211 adjusts the pulse width of a switching signal output through a switching terminal SW according to the voltage received through the feedback. For example, if the feedback voltage becomes lower than a previous voltage, the pulse width of the switching signal may be increased to a larger value than its previous state. The switching signal, which has been subject to pulse-width modulation, is applied to a terminal (e.g., the gate) of the transistor T1 of the boost converter 212 such that the level of the analog driving voltage AVDD output from the boost converter 212 is changed.

The HAVDD supply 220 receives the analog driving voltage AVDD from the DC-DC converter 210 to generate the half driving voltage HAVDD, which has a level lower than that of the analog driving voltage AVDDD. The HAVDD supply 220 includes first to fourth resistors R1 to R4, an operational amplifier (OP-AMP) A1, first and second transistors TR1 and TR2, and a second capacitor C2.

The first and second resistors R1 and R2 are connected to each other in series between an output terminal $V_A$ of the DC-DC converter 210 and a ground terminal $V_C$ receiving the ground voltage VSS. The first and second resistors R1 and R2 may have the same resistance value. For example, in at least one exemplary embodiment of the invention, the first and second resistors R1 and R2 have a value of 10 KΩ, but other exemplary embodiments are not limited thereto.

A first input terminal of the OP-AMP A1 is connected to a node $V_B$ connecting the first resistor R1 to the second resistor R2, and a second input terminal of the OP-AMP A1 is connected to a common node N1 to form a feedback loop. The electric potential at the connection node $V_B$ between the first and second resistors R1 and R2 has a voltage level corresponding to half (AVDD/2) of the analog driving voltage AVDD when the resistors R1 and R2 have the same resistance value.

The first supply voltage terminal of the OP-AMP A1 is connected to the output terminal $V_A$ of the DC-DC converter 210 to receive the analog driving voltage AVDD, and the second supply voltage terminal of the OP-AMP A1 is connected to the ground terminal $V_C$ to receive the ground voltage VSS. Since the OP-AMP A1 may function as a voltage follower, the connection node $V_B$ and an output terminal Aout of the OP-AMP A1 have the same voltage as AVDD/2.

The first and second transistors TR1 and TR2 may include a bipolar junction transistor (BJT). As an example, the first transistor TR1 includes an NPN transistor, and the second transistor TR2 includes a PNP transistor.

A collector terminal of the first transistor TR1 is connected to the output terminal $V_A$ of the DC-DC converter 210 to receive the analog driving voltage AVDD, an emitter terminal of the first transistor TR1 is connected to the common node N1, and a base terminal of the first transistor TR1 is connected to the output terminal Aout of the OP-AMP A1 through the third resistor R3. An emitter terminal of the second transistor TR2 is connected to the common node N1, a collector terminal of the second transistor TR2 is connected to the ground terminal $V_C$ to receive the ground voltage VSS, and a base terminal of the second transistor TR2 is connected to the output terminal Aout of the OP-AMP A1 through a fourth resistor R4.

The first and second transistors TR1 and TR2 may operate like a push-pull amplifier. The common output terminal (common node N1) of the first and second transistors TR1 and TR2 connected to the third and fourth resistors R3 and R4 may have the same voltage as that of the output terminal Aout of the OP-AMP A1. According to an exemplary embodiment of the present invention, the resistors R3 and R4 have the same resistance value (e.g., about 0.5 KΩ). Therefore, the output terminal Aout of the OP-AMP A1 has a voltage of AVDD/2 obtained through voltage division by the third and fourth resistors R3 and R4. The voltage at the common node N1 becomes AVDD/2, which may be the same as the voltage at the output terminal Aout of the OP-AMP A1.

The second capacitor C2 is connected to the input terminal of the OP-AMP A1 so that an input voltage (e.g., a half driving voltage HAVDD) at the connection node $V_B$ can be continuously applied to the input terminal of the OP-AMP A1.

The data driver 300 may include first to fourth power terminals 311, 312, 313, and 314, first and second OP-AMPs 301 and 302, and first and second output terminals 315 and 316. The first power terminal 311 of the data driver 300 receives the analog driving voltage AVDD. The second and third power terminals 312 and 313 are connected to the common node N1 of the HAVDD supply 220. The fourth terminal 314 receives the ground voltage VSS. Since the second and third power terminals 312 and 313 are connected to the common node N1, the second and third power terminals 312 and 313 can be integrated into one terminal.

The half driving voltage HAVDD is applied to the common node N1 by the OP-AMP A1 and the first and second transistors TR1 and TR2. Accordingly, the first power terminal 311 of the data driver 300 receives the analog driving voltage AVDD, and the second and third power terminals 312 and 313 receive the half driving voltage HAVDD. According to at least one exemplary embodiment, the half driving voltage HAVDD has a voltage level of AVDD/2 corresponding to the half of the analog driving voltage AVDD. The first OP-AMP 301 provided in the data driver 300 is supplied with the analog driving voltage AVDD and the half driving voltage HAVDD as power. The second OP-AMP 302 provided in the data driver 300 is supplied with the half driving voltage HAVDD and the ground voltage VSS as a power.

The LCD 1000 performing column inversion driving, alternately supplies a pair of complementary voltages corresponding to data signals to a column line every frame. Therefore, the power supply 200 according to an exemplary embodiment of the invention supplies the half driving voltage HAVDD to the data driver 300, which is a reference voltage for polarity inversion.

A portion of a current $I_B$ output from the second power terminal 312 of the data driver 300 flows into the third power terminal 313, and a remaining portion of the current $I_B$ flows into the terminal of the ground voltage VSS through the second transistor TR2. A current $I_C$ flowing into the third power terminal 313 is determined by a current, which is supplied through the first transistor TR1 by the analog driving voltage AVDD, and a portion of the current $I_B$ output from the second power terminal 312.

Since the output terminal Aout of the OP-AMP A1 is separated from the common node N1, the current $I_B$ output from the second power terminal 312 of the data driver 300 does not flow into the OP-AMP A1. In addition, since the second transistor TR2 can operate under a high-current and a high-power environment, the HAVDD supply 220 can stably operate.

By using the HAVDD supply 220, the power consumption in the liquid crystal panel 500 may correspond to AVDD*($I_B$*$I_C$), and the power consumption in the data driver 300 may correspond to $(AVDD-V_B)*I_B+V_C*I_C=1/2*AVDD*I_A$. As compared with the driving chip shown in FIG. 1, the power consumption of the data driver 300 is reduced to ½ due to the half driving voltage HAVDD applied through the HAVDD supply 220.

The protector 230 detects the half driving voltage HAVDD output from the HAVDD supply 220 to control the data driver 300 such that the data driver 300 normally operates. The protector 230 may further include a third transistor TR3, a fifth resistor R5, and a sixth resistor R6. The fifth and sixth resistors R5 and R6 are connected to each other between the common node N1 of the HAVDD supply 220 and a ground terminal to which the ground voltage VSS is applied. The third transistor TR3 may include a PNP bipolar transistor, but is not limited thereto. An emitter terminal of the third transistor TR3 is connected to the enable terminal EN of the PWM modulator 211, a collector terminal of the third transistor TR3 is connected to the ground terminal to receive the ground voltage VSS, and a base terminal of the third transistor TR3 is connected to a connection node N2 connecting the fifth resistor R5 to the sixth resistor R6. The third transistor TR3 may include a MOS transistor.

The protector 230 can control an on/off operation of the third transistor TR3 through voltage division based on the fifth and sixth resistors R5 and R6. If the fifth and sixth resistors R5 and R6 are suitably adjusted, the voltage (e.g., the voltage of the connection node N2) applied to the base terminal of the third transistor TR3 can be maintained higher than the voltage (e.g., the input voltage of the enable terminal EN of the PWM modulator 211) applied to the emitter terminal of the third terminal TR3 by a threshold voltage (e.g. 0.7 V or more). For example, if the magnitudes of the fifth and sixth resistors R5 and R6 are suitably adjusted, the voltage of the connection node N2 may maintain a level of about 4V or more. Therefore, when the HAVDD supply 220 normally operates, the third transistor TR3 is turned off.

However, if the voltage at the output terminal (e.g., the common node N1) of the HAVDD supply 220 is dropped to the ground voltage VSS when failures such as a short error occurs, the third transistor TR3 is turned on. Accordingly, the input voltage at the enable terminal EN of the PWM modulator 211 is dropped to the ground voltage VSS through the third transistor TR3 that has been turned on. In this example, the voltage applied to the enable terminal EN of the PWM modulator 211 may be maintained at about 1.2 V or less, thereby stopping the operation of the PWM modulator 211. Accordingly, the DC-DC converter 210 no longer generates the analog driving voltage AVDD.

When a voltage applied to the enable terminal EN is the threshold voltage (e.g., about 1.2 V or more), the PWM modulator 211 operates. However, when the voltage applied to the enable terminal EN is less than the threshold voltage (e.g., about 1.2 V), the PWM modulator 211 does not operate. In a normal operation, since the third transistor TR3 of the protector 230 is turned off, a voltage of the enable terminal EN can be maintained at the level (e.g., about 3.3 V) of the starting voltage HVS supplied from the timing controller 100.

When a short error occurs, for example, when the second transistor TR2 of the HAVDD supply 220 is shorted, the half driving voltage (e.g., a voltage at the common node N1) output from the HAVDD supply 220 can be dropped to the ground voltage VSS. Accordingly, the first OP-AMP 301 of the data driver 300 can receive a voltage exceeding an internal voltage thereof. In other words, when the second transistor TR2 is shorted, the electric potential at the output terminal (e.g., common node N1) of the HAVDD supply 220 is dropped to the ground voltage VSS. Accordingly, the two power terminals 311 and 312 of the first OP-AMP 301 of the data driver 300 receive the driving voltage AVDD and the ground voltage VSS, respectively, so that the first OP-AMP 301 can receive a voltage exceeding the internal voltage.

According to an exemplary embodiment of the present invention, when a short error occurs, the voltage at the base terminal of the third transistor TR3 drops, so that the third transistor TR3 is turned on. Accordingly, the voltage applied to the enable terminal EN of the PWM modulator 211 drops to the threshold voltage (e.g., about 1.2 V), so that the PWM modulator 211 does not operate. Therefore, the protector 230 prevents the analog driving voltage AVDD from being output from the DC-DC converter 212, so that a voltage exceeding the internal voltage of the data driver 300 is not applied to the data driver 300.

Figure 4A:
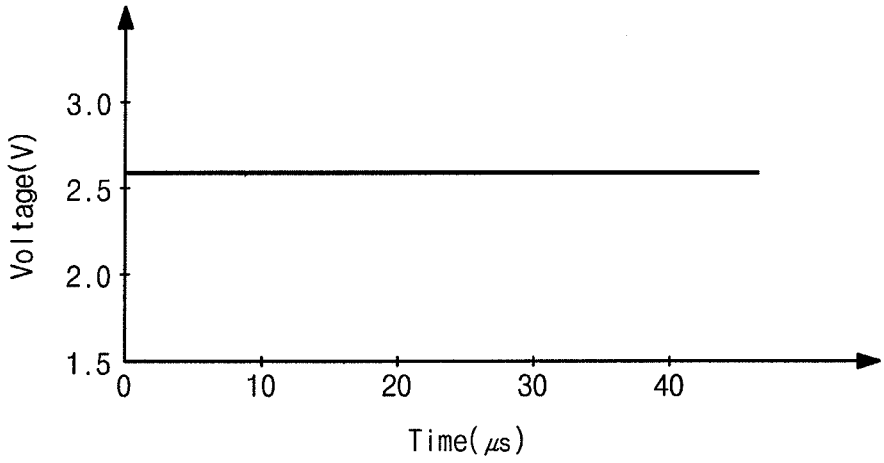
FIG. 4A is an exemplary graph showing a voltage of an enable terminal of the power supply during an initial driving.
Figure 4B:
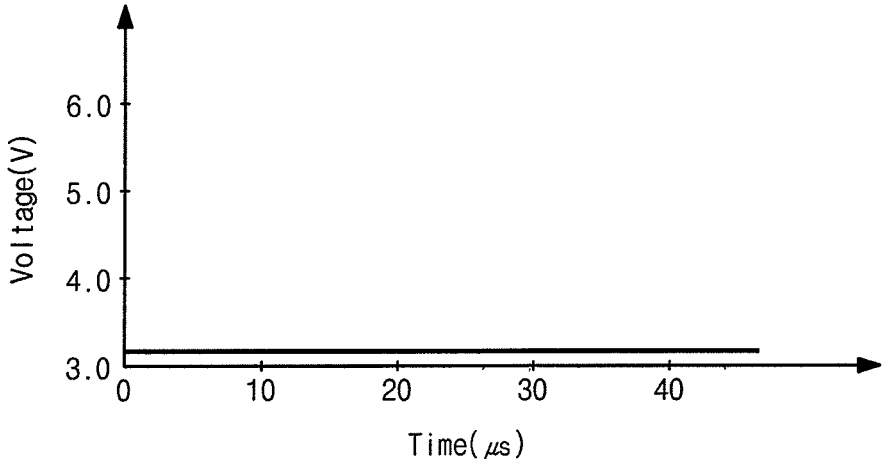
FIG. 4B is an exemplary graph showing a voltage of the enable terminal of the power supply during a normal driving.
Figure 4C:
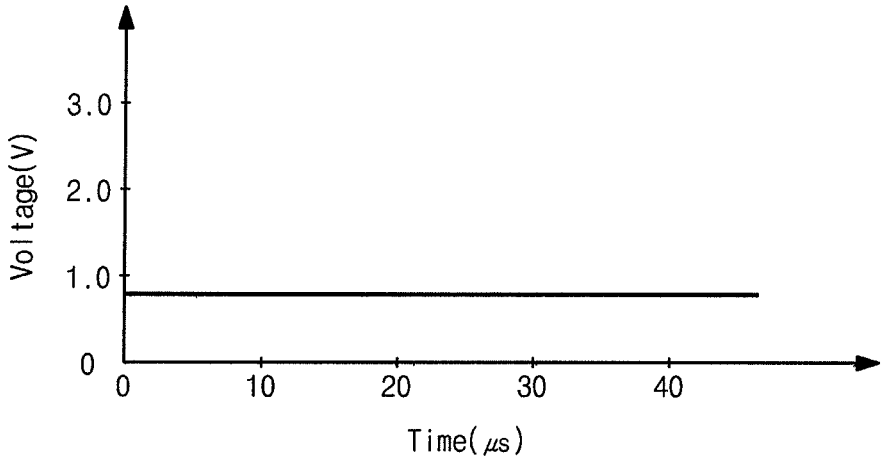
FIG. 4C is an exemplary graph showing a voltage of the enable terminal of the power supply when a short error occurs.

FIG. 4A is an exemplary graph showing a voltage at the enable terminal EN during an initial operation of the power supply 200, and FIG. 4B is an exemplary graph showing the voltage at the enable terminal EN during a normal operation of the power supply 200. FIG. 4C is an exemplary graph showing the voltage at the enable terminal EN when a short error occurs.

Referring to FIGS. 4A to 4C, a voltage exceeding the threshold voltage (e.g., about 1.2 V or more) is applied to the enable terminal EN in an initial and normal operation of the power supply 200. In contrast, when a short error occurs, the threshold voltage (e.g., about 1.2 V) or less is applied to the enable terminal EN by the turned-on third transistor TR3.

Accordingly, when the short error occurs in the HAVDD supply 220, the protector 230 performs a control operation such that the analog driving voltage AVDD is not applied to the data driver 300, thereby preventing the operation failure of the data driver 300.

Although exemplary embodiments of the present invention have been described, it is to be understood that the present invention is not limited to these exemplary embodiments and various changes and modifications can be made by one ordinary skilled in the art within the spirit and scope of the disclosure.

What is claimed is:

1. A power source circuit of a display apparatus, comprising:

a voltage generator providing a first driving voltage to a first supply voltage terminal;

a voltage divider connected between the first supply voltage terminal receiving the first driving voltage and a second supply voltage terminal receiving a ground voltage to generate a divided voltage;

an operational amplifier to receive the divided voltage and output the divided voltage as a second driving voltage;

a first switch connected between the first supply voltage terminal and a common node in response to the second driving voltage;

a second switch connected between the common node and the second supply voltage terminal in response to the second driving voltage; and a protector connected to the common node to limit a voltage output of the first supply voltage terminal in response to a voltage of the common node, wherein the protector disables the voltage generator when a voltage of the common node is the ground voltage.

2. The power source circuit of claim 1, wherein the protector comprises:

two resistors connected to each other in series between the common node and the second supply voltage terminal; and a third switch comprising a first terminal to receive a starting voltage, a second terminal connected to the second supply voltage terminal, and a third terminal connected to a connection node of the two resistors.

3. The power source circuit of claim 2, wherein the third switch comprises a PNP bipolar transistor.

4. The power source circuit of claim 1, wherein the first switch comprises a first transistor comprising a first terminal connected to the first supply voltage terminal, a second terminal connected to the common node, and a third supply voltage terminal to receive the second driving voltage, and wherein the second switch comprises a second transistor comprising a first terminal connected to the common node, a second terminal connected to the second supply voltage terminal, and a third terminal to receive the second driving voltage.

5. The power source circuit of claim 4, wherein the first transistor comprises an NPN bipolar transistor, and the second transistor comprises a PNP bipolar transistor.

6. The power source circuit of claim 4, wherein the operational amplifier comprises a first input terminal to receive the divided voltage and a second input terminal connected to the common node.

7. The power source circuit of claim 6, further comprising a first resistor connected between an output terminal of the operational amplifier and the third terminal of the first transistor; and a second resistor connected between the output terminal of the operational amplifier and the third terminal of the second transistor.

8. The power source circuit of claim 1, wherein the voltage divider comprises at least two resistors connected to each other in series between the first supply voltage terminal and the second supply voltage terminal, and wherein a voltage of a connection node of the two resistors is supplied to the operational amplifier as the divided voltage.

9. The power source circuit of claim 1, further comprising first and second output terminals commonly connected to the common node to output the second driving voltage.

10. A display apparatus comprising:

a power source circuit to supply a plurality of supply voltages;

a driving circuit that receives the supply voltages to output a grayscale voltage; and a display panel that receives the grayscale voltage to display an image, wherein the power source circuit comprises:

a first voltage generator that boosts an input voltage to generate a first driving voltage among the supply voltages;

a second voltage generator that receives the first driving voltage from the first voltage generator to generate a second driving voltage among the supply voltages having a level lower than a level of the first driving voltage; and a protector to control an operation of the first voltage generator according to a magnitude of the second driving voltage, wherein the second voltage generator comprises:

a voltage divider connected between a first supply voltage terminal receiving the first driving voltage and a second supply voltage terminal receiving a ground voltage to generate a divided voltage;

an operational amplifier to receive the divided voltage and output the divided voltage as the second driving voltage;

a first switch connected between the first supply voltage terminal and a common node in response to the second driving voltage;

a second switch connected between the common node and the second supply voltage terminal in response to the second driving voltage; and wherein the protector disables the voltage generator when a voltage of the common node is the ground voltage.

11. The display apparatus of claim 10, wherein the protector comprises:

two resistors connected to each other in series between the common node and the second supply voltage terminal; and a third switch comprising a first terminal to receive a starting voltage, a second terminal connected to the second supply voltage terminal, and a third terminal connected to a connection node of the two resistors.

12. The display apparatus of claim 11, wherein the third switch comprises a PNP bipolar transistor.

13. The display apparatus of claim 10, wherein the first switch comprises a first transistor comprising a first terminal connected to the first supply voltage terminal, a second terminal connected to the common node, and a third terminal to receive the second driving voltage, and wherein the second switch comprises a second transistor comprising a first terminal connected to the common node, a second terminal connected to the second supply voltage terminal, and a third terminal to receive the second driving voltage.

14. The display apparatus of claim 13, wherein the first transistor comprises an NPN bipolar transistor, and the second transistor comprises a PNP bipolar transistor.

15. The display apparatus of claim 10, wherein the operational amplifier comprises a first input terminal to receive the divided voltage and a second input terminal connected to the common node to receive the second driving voltage.

16. The display apparatus of claim 15, further comprising:

a first resistor connected between an output terminal of the operational amplifier and the third terminal of the first transistor; and a second resistor connected between the output terminal of the operational amplifier and the third terminal of the second transistor.

17. The display apparatus of claim 10, wherein the voltage divider comprises at least two resistors connected to each other in series between the first supply voltage terminal and the second supply voltage terminal, and wherein the operational amplifier receives a voltage of a connection node of the two resistors as the divided voltage.

18. The display apparatus of claim 10, wherein the driving circuit comprises a first power terminal to receive the first driving voltage, second and third power terminals commonly connected to the common node to receive the second driving voltage, and a fourth power terminal to receive a ground voltage.

19. The display apparatus of claim 18, wherein the driving circuit further comprises first and second amplifiers, wherein two supply voltage terminals of the first amplifier are connected to the first and second power terminals, respectively, and wherein two supply voltage terminals of the second amplifier are connected to the third and fourth power terminals, respectively.

20. The display apparatus of claim 10, wherein the second voltage at the second level indicates that a short has occurred within the second voltage generator.

21. The display apparatus of claim 10, wherein the second level is a ground voltage.

* * * * *